US006362715B1

(12) United States Patent
Chiang et al.

(10) Patent No.: US 6,362,715 B1
(45) Date of Patent: Mar. 26, 2002

(54) TRANSFORMER WITH HIGH COUPLING EFFICIENCY

(75) Inventors: Shen-Long Chiang, Taipei; Ching-Fu Hsueh, Taoyuan, both of (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/691,661

(22) Filed: Oct. 17, 2000

(30) Foreign Application Priority Data

Nov. 3, 1999 (TW) ..... 088119124 A

(51) Int. Cl.[7] ..... H01F 5/00; H01F 27/28

(52) U.S. Cl. ..... 336/198; 336/200; 336/208; 336/192

(58) Field of Search ..... 336/200, 198, 336/192, 208

(56) References Cited

U.S. PATENT DOCUMENTS 5,319,342 A * 6/1994 Kuroki ..... 336/170
5,461,353 A * 10/1995 Eberhardt ..... 333/246
5,754,088 A * 5/1998 Fletcher et al. ..... 336/200
5,996,214 A * 12/1999 Bell ..... 29/605
6,144,278 A * 11/2000 Nishida et al. ..... 336/92

* cited by examiner

*Primary Examiner*—Anh Mai
(74) *Attorney, Agent, or Firm*—Oppenheimer Wolff & Donnelly, LLP

(57) ABSTRACT

The present invention provides a transformer with high coupling efficiency including a substrate, a bobbin, and a device. The substrate with M sets of pads and M sets of lower conducting wires is defined to have a front surface and a rear surface. Each pad on the substrate is provided as a connecting point for the front surface and the rear surface of the substrate. Each set of pads includes a first pad and a second pad connecting to each other by one corresponding lower conducting wire. The bobbin functioning as a winding reel for the high-voltage conducting wire is provided on the substrate. A device including N sets of upper conducting wires is disposed on the bobbin. Each set of upper conducting wire connect the first pad of one set of pads with the second pad of another set of pads adjacent to the one set of pads to form a low-voltage winding loop on the device and the rear surface of the substrate.

16 Claims, 4 Drawing Sheets

TRANSFORMER WITH HIGH COUPLING EFFICIENCY

FIELD OF THE INVENTION

The present invention relates to a transformer, and more particularly, to a transformer with high coupling efficiency.

BACKGROUND OF THE INVENTION

A chip coil transformer is an important device in the surface mounting technology and it is usually assembled on a circuit substrate to provide a variety of voltages for the circuit.

FIG. 1 illustrates the chip coil transformer 10 of the prior art. The prior chip coil transformer 10 includes a bobbin 12, low-voltage conducting wires 13, high-voltage conducting wires 14, and a core 15. A plurality of partitions 16 and pins 17 are disposed on the bobbin 12. A winding region 18 is formed between two of the partitions 16, and there are seven winding regions 18–24 formed on the bobbin 12 as shown in FIG. 1. Low-voltage conducting wires 13 are wound onto the winding region 18 to form a low-voltage winding loop. High-voltage conducting wires 14 are wound onto the winding region 19–24 to form a high-voltage winding loop. Each two of the winding regions 18–24 are isolated by means of each corresponding partition 16. Besides, each pin 17 functions as an output and an input for the low-voltage conducting wires 13 or the high-voltage conducting wires 14.

However, because the low-voltage conducting wires 13 and the high-voltage conducting wires 14 are wound onto the same bobbin 12, the coupling efficiency of the low-voltage winding loop and the high-voltage winding loop on the winding regions 18 and 24, which are at both ends of the bobbin 12, is not desirable. The length of the bobbin 12 is not easy to be reduced either. Moreover, each of the partitions 16 provided to isolate the winding regions 18–24 occupies a certain space, and therefore the industry faces a technical problem in minimizing the electronic parts.

SUMMARY OF THE INVENTION

To solve the above problem, the present invention provides a transformer with high coupling efficiency including a substrate, a bobbin, and a device. The substrate having M sets of pads and M sets of lower conducting wires is defined to have a front surface and a rear surface. Each set of pads includes a first pad and a second pad provided on the substrate acting as connecting point for the front surface and the rear surface of the substrate. Each set of the lower conducting wire is provided on the rear surface of the substrate to connect the first pad and the second pad of the corresponding set of pads. The bobbin is provided on the substrate functioning as a winding reel for a high-voltage conducting wire. The device having N sets of upper conducting wires is disposed on the bobbin. Each set of upper conducting wire connect the first pad of one set of pads with the second pad of another set of pads adjacent to the one set of pads. And these N sets of upper conducting wires connect respectively with the M sets of lower conducting wires by these M sets of pads to form a low-voltage winding loop on the device and the rear surface of the substrate. Because the low-voltage winding loop and the high-voltage winding loop of the present invention are located respectively on the device, the rear surface of the substrate, and the bobbin, the transformer of the present invention may have higher coupling efficiency. Besides, because there appears to be no partition formed on the bobbin, the transformer of the present invention is characterized by minimizing its volume.

DETAILED DESCRIPTION OF THE INVENTION

Figure 2:
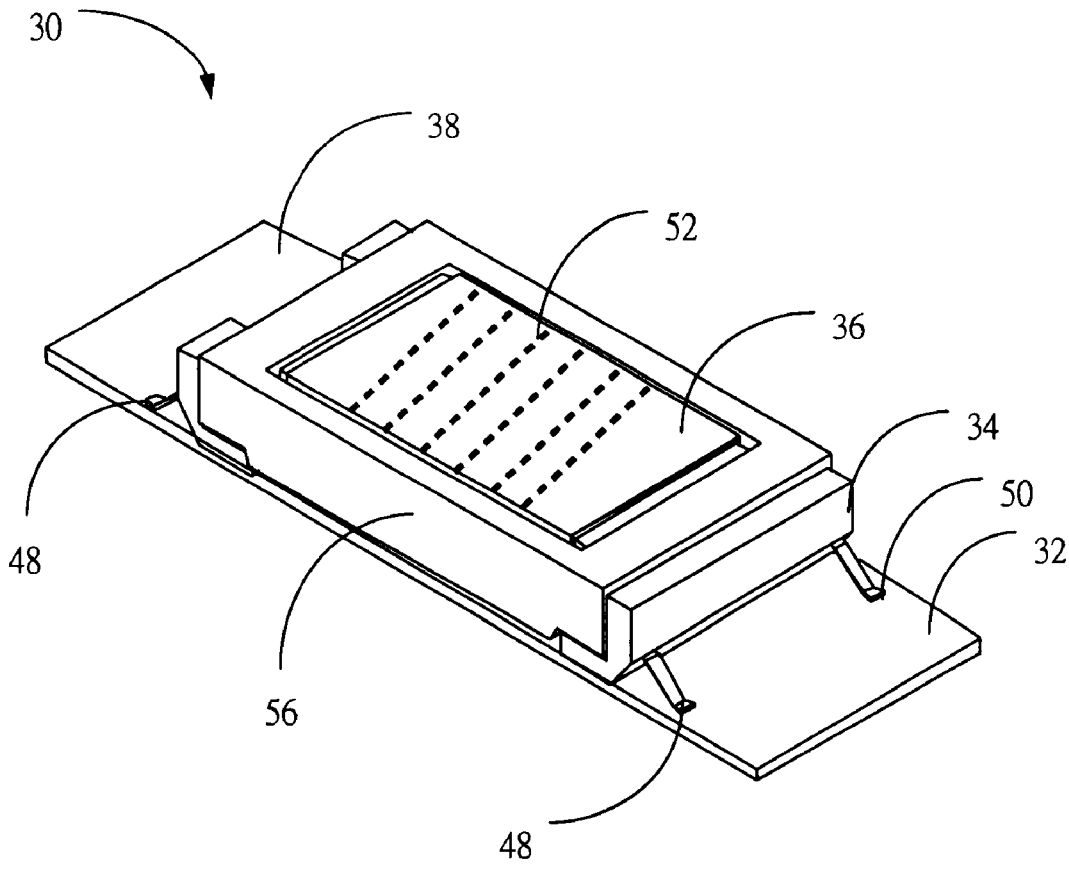
FIG. 2 illustrates the transformer according to the present invention.
Figure 3:
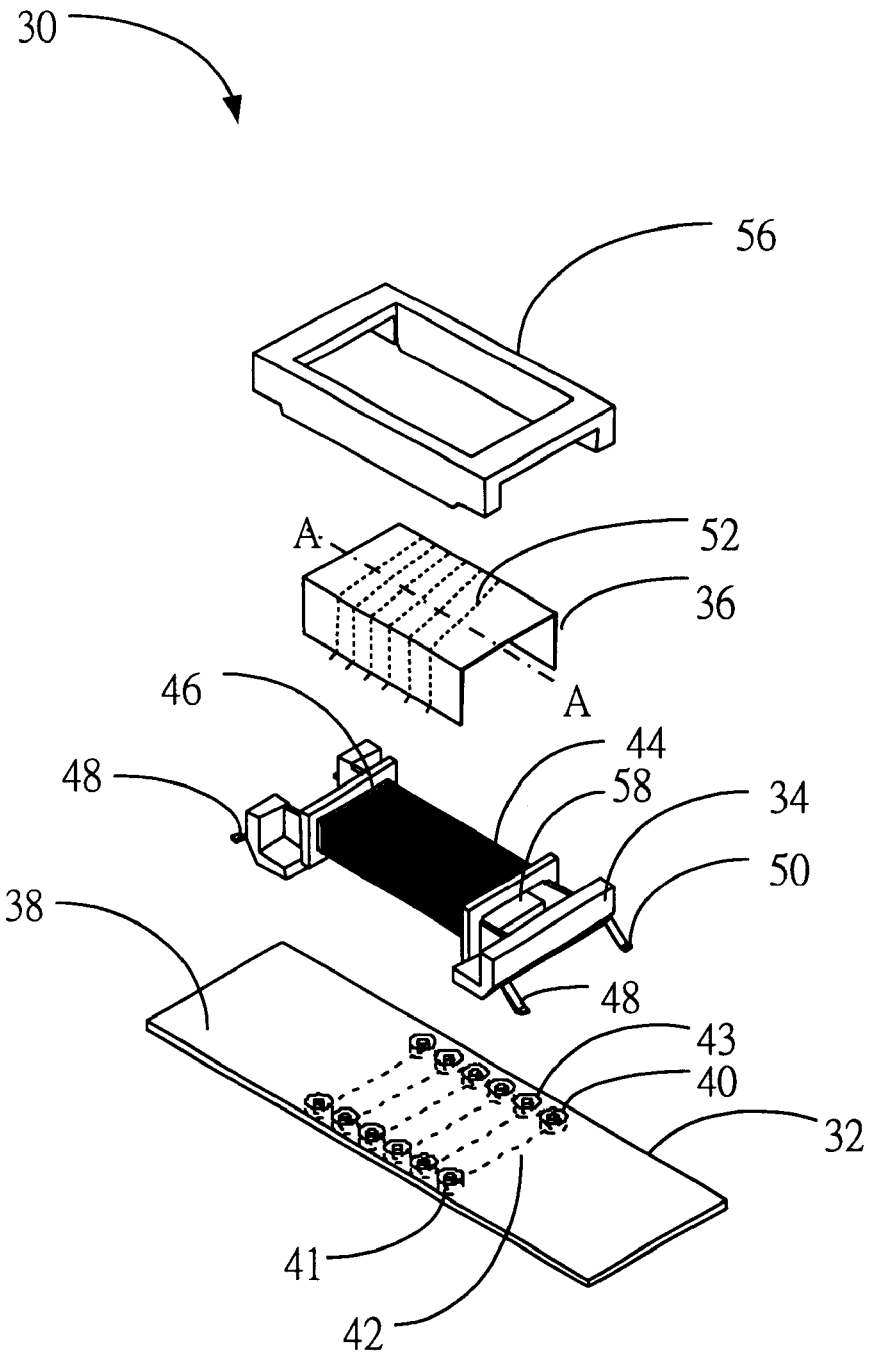
FIG. 3 illustrates an assembling diagram of the transformer as shown in FIG. 2.

Please refer to FIG. 2 and FIG. 3. FIG. 2 illustrates the transformer 30 according to the present invention. FIG. 3 is an assembling diagram of the transformer 30 as shown in FIG. 2. The transformer 30 of the present invention includes a substrate 32, a bobbin 34, and a device 36. The substrate 32 may be a single-layer, a double-layer, or a multiple-layer printing circuit board. Take the double-layer printing circuit board for example, the substrate 32 having M sets of pads 40 and M sets of lower conducting wires 42 is defined to have a front surface 38 and a rear surface 39 (not shown). Each set of pads includes a first pad 40 and a second pad 41, and each pad 40 is provided on the substrate 32 as a connecting point for the front surface 38 and the rear surface 39 of the substrate 32, wherein each pad 40 may be a copper foil passing through the substrate 32. Each set of lower conducting wire 42 is provided on the rear surface 39 of the substrate 32 to connect the first pad 40 and the second pad 41 of one corresponding set of pads.

Figure 4:
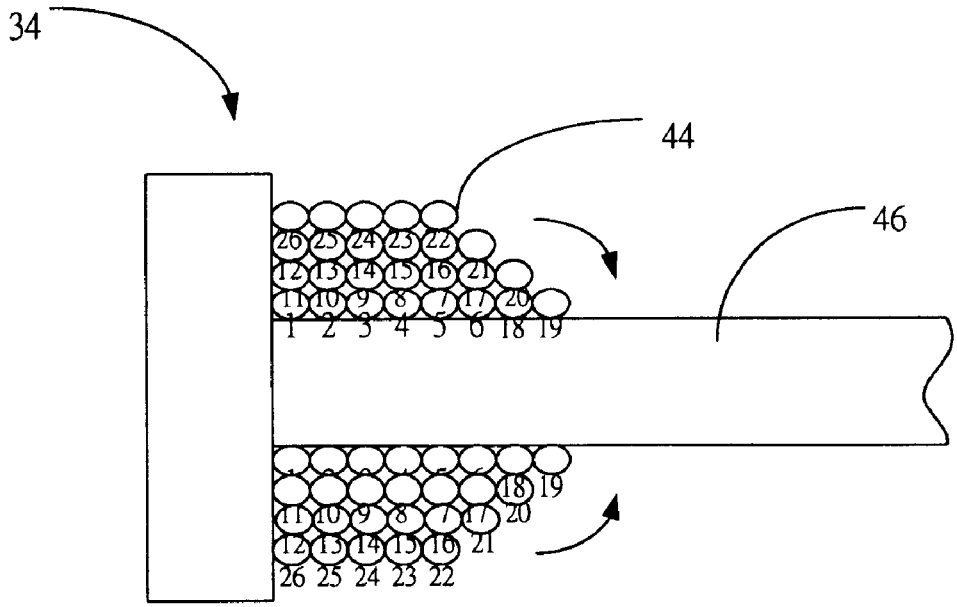
FIG. 4 illustrates the high-voltage windings of the bobbin as shown in FIG. 3.

Please refer to FIG. 3 and FIG. 4. FIG. 4 illustrates the high-voltage windings of the bobbin 34 as shown in FIG. 3. The numbers 1–26 as shown in FIG. 4 indicate the order of the winding circles of the high-voltage conducting wire 44. The bobbin 34 is provided on the substrate 32 functioning as a winding reel for the high-voltage conducting wires 44. The bobbin 34 includes a reel 46 and four pins 48 and 50. The four pins 48, 50 are formed at the both ends of the bobbin 34 respectively, wherein the two pins 48 act as the input and the output for the high-voltage conducting wires 44, and the other two pins 50 act as the fixed pins for the bobbin 34. Besides, the high-voltage conducting wires 44 are equally wound onto the reel 46 according to a predetermined procedure, wherein the high-voltage conducting wires 44 as shown in FIG. 4 follow the order of the winding circles to form a high-voltage winding loop on the reel 46.

Figure 5:
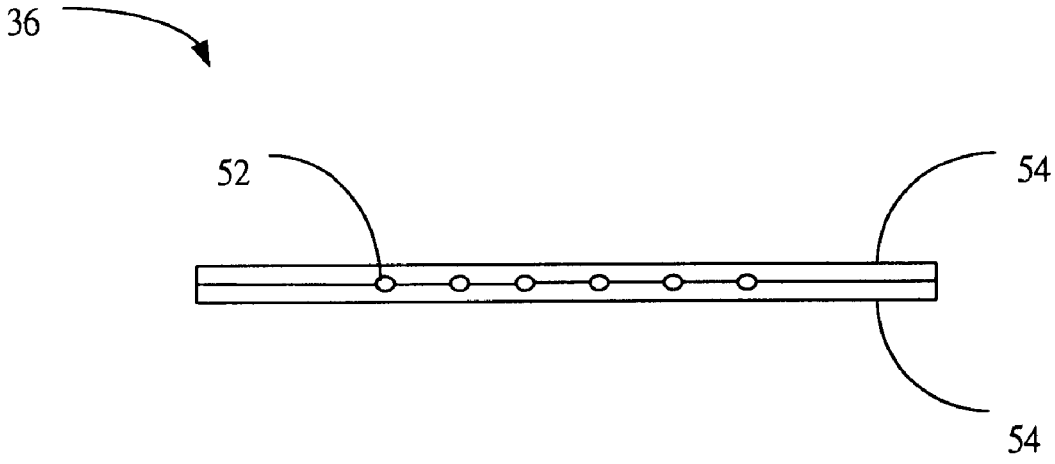
FIG. 5 shows a profile of the device along the A—A hatch as shown in FIG. 3.

Please refer to FIG. 3 and FIG. 5. FIG. 5 is a profile of the device 36 along the A—A hatch as shown in FIG. 3. The device 36 having N sets of upper conducting wires 52 and two isolated shells 54 is disposed on the bobbin 34. The N sets of upper conducting wires 52 formed inside the two isolated shells 54 as shown in FIG. 5 is parallel to each other. Each upper conducting wire connects with the first pad 41 of one set of pads and the second pad 43 of another set of pads on the substrate 32. Besides, one of the two isolated shells 54 may be a flexible printing circuit, and the N sets of upper conducting wires 52 may be directly printed on the flexible printing circuit according to a printing process.

Please refer to FIG. 3. N sets of upper conducting wires 52 of the device 36 connect with M sets of lower conducting wires 42 through M sets of pads 40 to form a low-voltage winding loop on the device 36 and the rear surface 39 of the substrate 32. For example, the first pad 40 and the second pad 41 of one set of pads on the substrate are connected by the lower conducting wires 42, and the first pad 41 of one set of pads and the second pad 43 of another set of pads on the substrate 32 are connected by the upper conducting wires 52. Therefore, the pad 40 and the pad 43 are connected by the upper and the lower conducting wires 52, 42. And the rest may be deduced by analogy, then N sets of the upper conducting wires 52 and M sets of the lower conducting wires 42 form a low-voltage winding loop on the device 36 and the rear surface 39 of the substrate 32 by means of M sets of pads 40, 41, 43.

Figure 1:
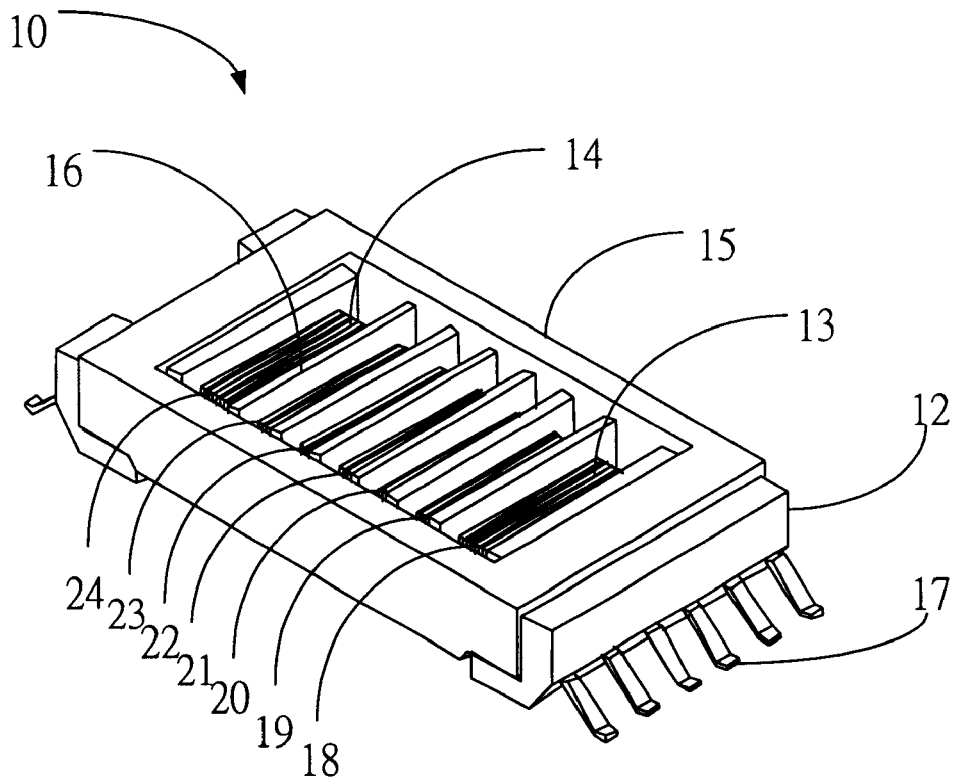
Fig. 1 Prior Art
FIG. 1 illustrates the chip coil transformer of the prior art.

The high-voltage winding loop of the transformer 30 of the present invention is formed by winding high-voltage conducting wires onto the bobbin 34 according to a predetermined procedure. The low-voltage winding loop is formed on the device 36 and the rear surface 39 of the substrate 32 by means of N sets of upper conducting wires 52, M sets of lower conducting wires 42 and M sets of pads 40, 41, 43. Because the low-voltage winding loop is wound equally around the periphery of the high-voltage winding loop, the transformer 30 of the present invention may have higher coupling efficiency. Besides, because the bobbin 34 is only used for holding the high-voltage winding loop, the bobbin 34 may be made into a shorter length. Additionally, partitions may also be disposed on the reel 46 of the bobbin 34 if needed (according to the prior art as shown in FIG. 1). Take the no-partition case for example. Because the premise of the present invention is to obtain a larger winding surface, the bobbin 34 of the transformer 30 according to the present invention has an advantage in minimizing the volume in order to further save the space. Moreover, because the low-voltage winding loop of the transformer 30 according to the present invention is formed on the device 36 and the rear surface 39 of the substrate 32, the input and the output (not shown) of the low-voltage winding loop may be formed on the substrate 32. Therefore, the bobbin 34 only requires four pins 48, 50 to be the input and the output of the high-voltage windings and to fix the bobbin 34.

Please refer to FIG. 3. The transformer 30 of the present invention further includes an upper core 56 and a lower core 58. The assembling procedure of the transformer 30 is described hereinafter. First, prepare the substrate 32 having M sets of pads 40, 41, 43 and lower conducting wires 42. Prepare the device 36 having N sets of upper conducting wires 48. Next, loop the high-voltage conducting wires 44 equally onto the reel 46 of the bobbin 34 to form the high-voltage windings loop. Assemble the bobbin 34 on the substrate 32. Dispose the device 36 on the bobbin 34, and connect the upper conducting wires 52 and the corresponding pads 41, 43 on the substrate 32 to form the low-voltage winding loop. Finally, assemble the lower core 58 in the bobbin 34 and assemble the upper core 56 on the bobbin 34.

In contrast to the chip coil transformer 10 in the prior art, the transformer 30 of the present invention applies the high-voltage conducting wires 44 to loop on the bobbin 34 according to a predetermined procedure to form a high-voltage winding loop. The transformer 30 of the present invention applies N sets of upper conducting wires 52, M sets of lower conducting wires 42, and M sets of pads 40, 41, 43 to form the low-voltage winding loop on the device 36 and the rear surface 39 of the substrate. Because the low-voltage winding loop is equally wound around the periphery of the high-voltage windings, the transformer 30 of the present invention has higher coupling efficiency. Besides, the bobbin 34 has no partition. Because the premise of the present invention is to obtain a larger winding surface, the bobbin 34 of the transformer 30 according to the present invention has the advantage in minimizing the volume. Moreover, the bobbin 34 of the transformer 30 of the present invention requires only four pins 48, 50 to be the output and the input of the high-voltage winding loop and to fix the bobbin 34.

According to the preferred embodiment mentioned above, the features and spirits of the invention are hopefully well described. For example, the M sets of lower conducting wires of the present transformer may also be formed in the substrate, wherein the substrate is a multiple-layer printing circuit board. Besides, the M sets of lower conducting wires may also be formed on the front surface of the substrate. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A transformer, comprising:

a substrate, said substrate comprising M sets of pads and M sets of lower conducting wires, each set of pads including a first pad and a second pad connecting to each other by one corresponding lower conducting wire, each pad being formed on said substrate;

a bobbin, disposed over said substrate, acting as a winding reel for a high-voltage conducting wire; and a winding device, said winding device being disposed over said bobbin and comprising N sets of upper conducting wires, each set of upper conducting wire connecting said first pad of one set of pads with said second pad of another set of pads adjacent to said one set of pads;

wherein a low-voltage winding loop is formed by electrically connecting said N sets of upper conducting wires with said M sets of lower conducting wires.

2. The transformer of claim 1, wherein said substrate is defined to have a front surface and a rear surface, each set of pads being disposed on said front surface, and each set of lower conducting wire being disposed on said rear surface.

3. The transformer of claim 2, wherein said winding device comprises two isolated shells, said N sets of upper conducting wires parallel to one another being disposed between said two isolated shells.

4. The transformer of claim 3, wherein at least one of said two isolated shell is a flexible printing circuit.

5. The transformer of claim 4, wherein said N sets of upper conducting wires are printed on said flexible printing circuit according to a printing process.

6. The transformer of claim 1, wherein said transformer is assembled by an assembling process, said assembling process comprising the steps of:

preparing said substrate comprising said M sets of pads and said M sets of lower conducting wires;

preparing said winding device comprising said N sets of upper conducting wires;

winding said high-voltage conducting wire equally onto said winding reel of said bobbin to form a high-voltage winding loop;

assembling said bobbin onto said substrate;

disposing said winding device on said bobbin and connecting said first pad of one set of pads with said second pad of another set of pads adjacent to said one set of pads on said substrate by each set of upper conducting wire to form a low-voltage winding loop;

assembling a lower core in said bobbin; and assembling an upper core on said bobbin.

7. The transformer of claim 1, wherein each set of pads are copper foil.

8. A transformer comprising:

a substrate comprising a plurality of lower conducting wires;

a winding device attached onto the substrate, the winding device comprising a plurality of upper conducting wires and a bottom concavity; and a bobbin disposed between the substrate and the winding device, and a coupling portion of the bobbin extended within the bottom concavity;

a first winding loop wound around the coupling portion of the bobbin, wherein a second winding loop is formed by electrically connecting the plurality of upper conducting wires with the plurality of lower conducting wires, and the first winding loop wound around the bobbin is partially enclosed by the second winding loop.

9. The transformer of claim 8, wherein the substrate further comprises a first and a second sets of pads, each set of pads comprising a first pad and a second pad connecting to each other by one corresponding lower conducting wire, the upper conducting wire electrically connecting the first pad of the first set of pads with the second pad of the second set of pads.

10. The transformer of claim 9, wherein the substrate has a front surface and a rear surface, each set of pads being disposed on the front surface, and each set of lower conducting wire being disposed on the rear surface.

11. The transformer of claim 8, wherein the winding device is formed by overlapping two isolated shells, and the plurality of upper conducting wires is disposed between the two isolated shells.

12. The transformer of claim 11, wherein one of the two isolated shells is a flexible printing circuit board, and the plurality of upper conducting wires are printed on the flexible printing circuit board.

13. The transformer of claim 8, wherein the winding device is a substantially U-shaped, and the bottom concavity is formed in the center of the bottom surface.

14. The transformer of claim 8, wherein the plurality of upper conducting wires are parallel extended on the winding device.

15. The transformer of claim 8, wherein the bobbin further comprises a reel, and the first winding loop is formed by firstly winding a metal wire around the reel to form a first layer of routing to completely cover the reel, and then secondly winding the metal wire onto the first layer of routing to form a second layer of routing to completely cover the first layer of routing.

16. An assembling process of a transformer, the assembling process comprising the steps of:

preparing a substrate comprising a first and a second sets of pads, a first and a second lower conducting wires, the first and the second lower conducting wires connecting the first and the second sets of pads respectively;

preparing a winding device comprising a plurality of upper conducting wires and a bottom cavity;

preparing a bobbin with a first winding loop wound around the bobbin;

attaching the bobbin onto the substrate;

attaching the winding device onto the substrate to make the bobbin partially received within the bottom cavity;

inserting a lower core into the bobbin; and assembling an upper core above the bobbin;

wherein a second winding loop is formed by electrically connecting a first end of the upper conducting wire to the first pad of the first set of pads, and connecting a second end of the upper conducting wire to the second pad of the second set of pads, so that the first winding loop wound around the bobbin is partially enclosed by the second winding loop.

* * * * *